US011814243B1

(12) United States Patent
Christian

(10) Patent No.: US 11,814,243 B1
(45) Date of Patent: Nov. 14, 2023

(54) TWO-PART GARBAGE CAN WITH TWIST-ON SIDEWALL

(71) Applicant: 3 BOYS ENTERPRISES, LLC, Gallatin, TN (US)

(72) Inventor: Jeffrey S. Christian, Gallatin, TN (US)

(73) Assignee: 3 Boys Enterprises, LLC, Gallatin, TN (US)

( * ) Notice: Subject to any disclaimer, the term of this patent is extended or adjusted under 35 U.S.C. 154(b) by 0 days.

(21) Appl. No.: 18/051,924

(22) Filed: Nov. 2, 2022

(51) Int. Cl.
*B65F 1/06* (2006.01)

(52) U.S. Cl.
CPC ..... *B65F 1/06* (2013.01); *B65F 2230/00* (2013.09)

(58) Field of Classification Search
CPC ..... B65F 1/06; B65F 1/1415; B65F 2230/00; B65F 2230/15
USPC ..... 220/625, 908, 908.1, 495.08, 495.06, 220/495.11, 4.09, 495.01
See application file for complete search history.

(56) References Cited

U.S. PATENT DOCUMENTS

| | | | | |
|---|---|---|---|---|
| 3,997,072 | A | 12/1976 | Guth | |
| 4,222,580 | A * | 9/1980 | Krokonko | B65F 1/1468 280/79.5 |
| 4,643,380 | A | 2/1987 | Copeland | |
| 4,842,228 | A | 6/1989 | Kasper | |
| 6,508,377 | B1 | 1/2003 | Griswold et al. | |
| 6,815,036 | B1 | 11/2004 | Romero | |
| 7,500,430 | B2 | 3/2009 | Claflin et al. | |
| 9,815,622 | B2 | 11/2017 | Dafoe | |
| 10,858,181 | B1 | 12/2020 | Christian | |
| D919,378 | S * | 5/2021 | Rocq | D7/629 |
| 2002/0003144 | A1 | 1/2002 | Grimes | |
| 2003/0209549 | A1 | 11/2003 | Grimes | |
| 2005/0230572 | A1 | 10/2005 | Fisher | |
| 2008/0023480 | A1 | 1/2008 | Fisher | |
| 2010/0282765 | A1 | 11/2010 | Hayes | |
| 2013/0048641 | A1 | 2/2013 | Romano | |

FOREIGN PATENT DOCUMENTS

| | | | |
|---|---|---|---|
| EP | 1580148 | A1 | 9/2005 |
| JP | 2003267505 | A | 9/2003 |

(Continued)

OTHER PUBLICATIONS

International Search Report issued in International Patent Application No. PCT/US2021/036395 dated Sep. 10, 2021.

(Continued)

*Primary Examiner* — John K Fristoe, Jr.
*Assistant Examiner* — Elizabeth J Volz
(74) *Attorney, Agent, or Firm* — United IP Counselors, LLC

(57) ABSTRACT

A trash can has a separable sidewall and a base. The sidewall has an upper end and a lower end spaced from the upper end, both of which are open. A set of slots open at the lower end of the sidewall and extend upward from the lower end into the sidewall with a directional change. The base is adapted to accommodate the sidewall so as to close the lower end of the sidewall. The base has a raised perimeter wall with a set of protections along an inner face that are engageable with the slots in the sidewall. The sidewall is without a constriction in width toward its lower end. The sidewall may increase in diameter from the upper end toward the lower end.

5 Claims, 3 Drawing Sheets

(56) References Cited

FOREIGN PATENT DOCUMENTS

| | | |
|---|---|---|
| KR | 100966235 B1 | 6/2010 |
| KR | 200490961 Y1 | 1/2020 |

OTHER PUBLICATIONS

Joseph Joseph, "Totem Waste & Recycling Trash Can." Internet. https://us.josephjoseph.com/collections/waste-recycling-bins/products/totem-max-and-compact-waste-recycling-bins?variant=31990019915854 (last visited Jun. 11, 2020).
Written Opinion issued in International Patent Application No. PCT/US2021/036395 dated Sep. 10, 2021.

* cited by examiner

TWO-PART GARBAGE CAN WITH TWIST-ON SIDEWALL

TECHNICAL FIELD

The invention relates to trash cans, and specifically, to a trash can with a separable, twist-off sidewall and base.

BACKGROUND

Trash cans store waste until it can be collected for transport to a landfill or some other storage or reclamation facility. Among the simplest of devices used in the home, some trash cans are little more than a bucket, although more advanced models with automatic lids and other features are available. A trash bag or liner is usually used in a trash can to make it easier to remove the waste from the trash can. Yet removing a filled trash bag from a trash can is often an ordeal.

Over the years, some trash cans with a separable sidewall and base have been invented. Instead of lifting a filled trash bag out of the trash can, these trash cans allow one to remove the sidewall from the base to access the filled trash bag. For example, U.S. Pat. No. 9,815,622 discloses a trash can with a separable base and sidewall. The bottom of the sidewall carries a lip with engaging structure that allows it to twist onto its base. Toward the base, where the engaging structure is found, the sidewall has a constriction in its width.

BRIEF SUMMARY

One aspect of the invention relates to a trash can. The trash can has a separable sidewall and a base. The sidewall has an upper end and a lower end spaced from the upper end, both of which are open. A set of slots open at the lower end of the sidewall and extend upward from the lower end into the sidewall with a directional change. The base is separable from the sidewall and is adapted to accommodate the sidewall so as to close the lower end of the sidewall. The base has a raised perimeter wall with a set of protections along an inner face that are engageable with the slots in the sidewall. The sidewall is without a constriction in width toward its lower end.

In one embodiment, the sidewall has round cross-sections and increases in diameter from the upper end toward the lower end. The sidewall may have a plane of maximum diameter proximate to its lower end, below which it keeps a constant cross-section.

In a trash can according to this embodiment of the invention, the interaction of the slots in the sidewall and the projections on the base allows the sidewall to be removed from the base with a twisting of the sidewall.

Other aspects, features, and advantages of the invention will be set forth in the following description.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
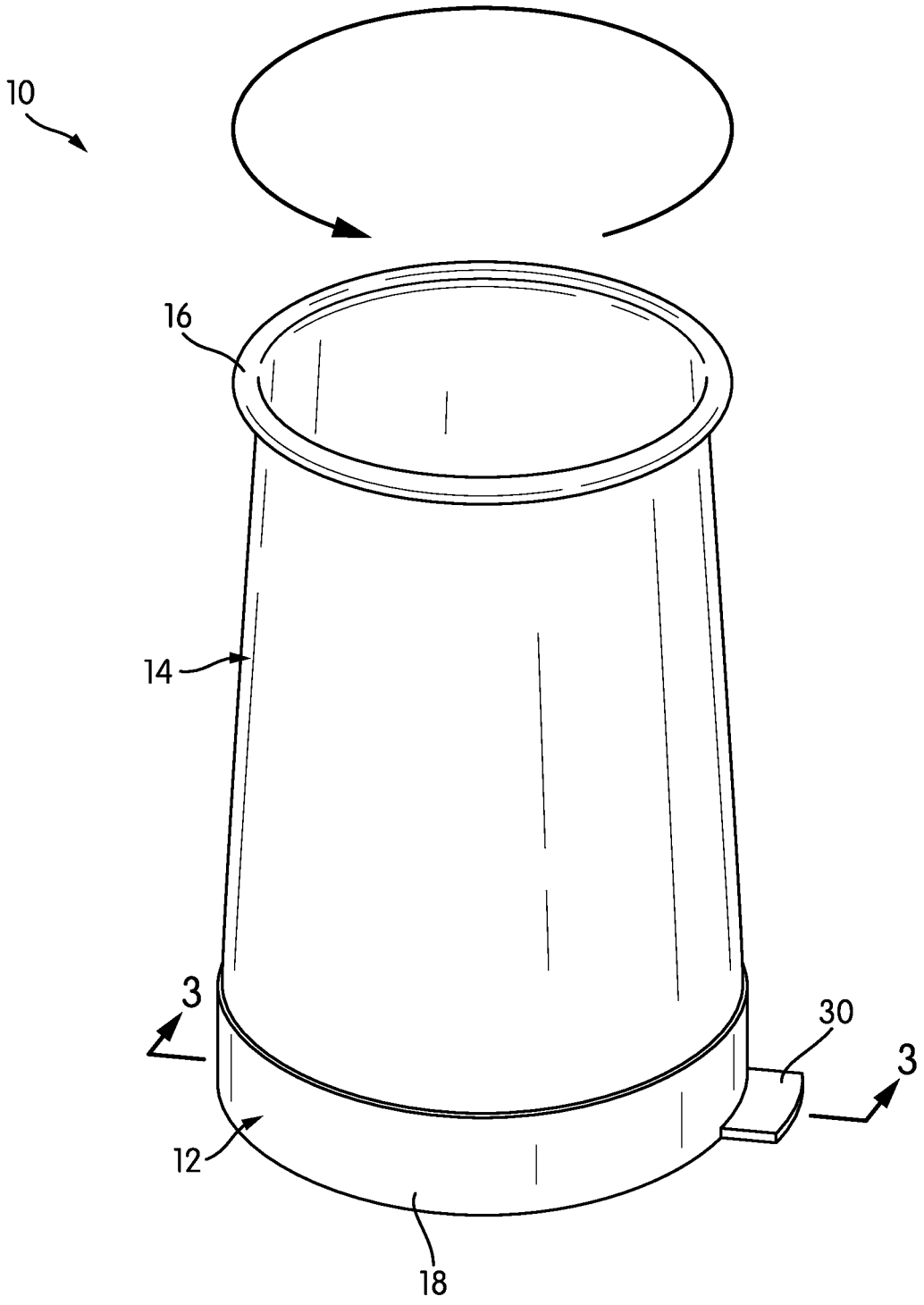
FIG. 1 is a perspective view of a trash can with a separable base and sidewall according to one embodiment of the invention.

FIG. 1 is a perspective view of a trash can, generally indicated at 10, with a separable base 12 and sidewall 14. The trash can 10 has a rounded overall appearance, wider at the base 12 than it is at the top of the sidewall 14. The top of the sidewall 14 defines an outwardly-curved lip 16, on which a lid may rest.

Figure 2:
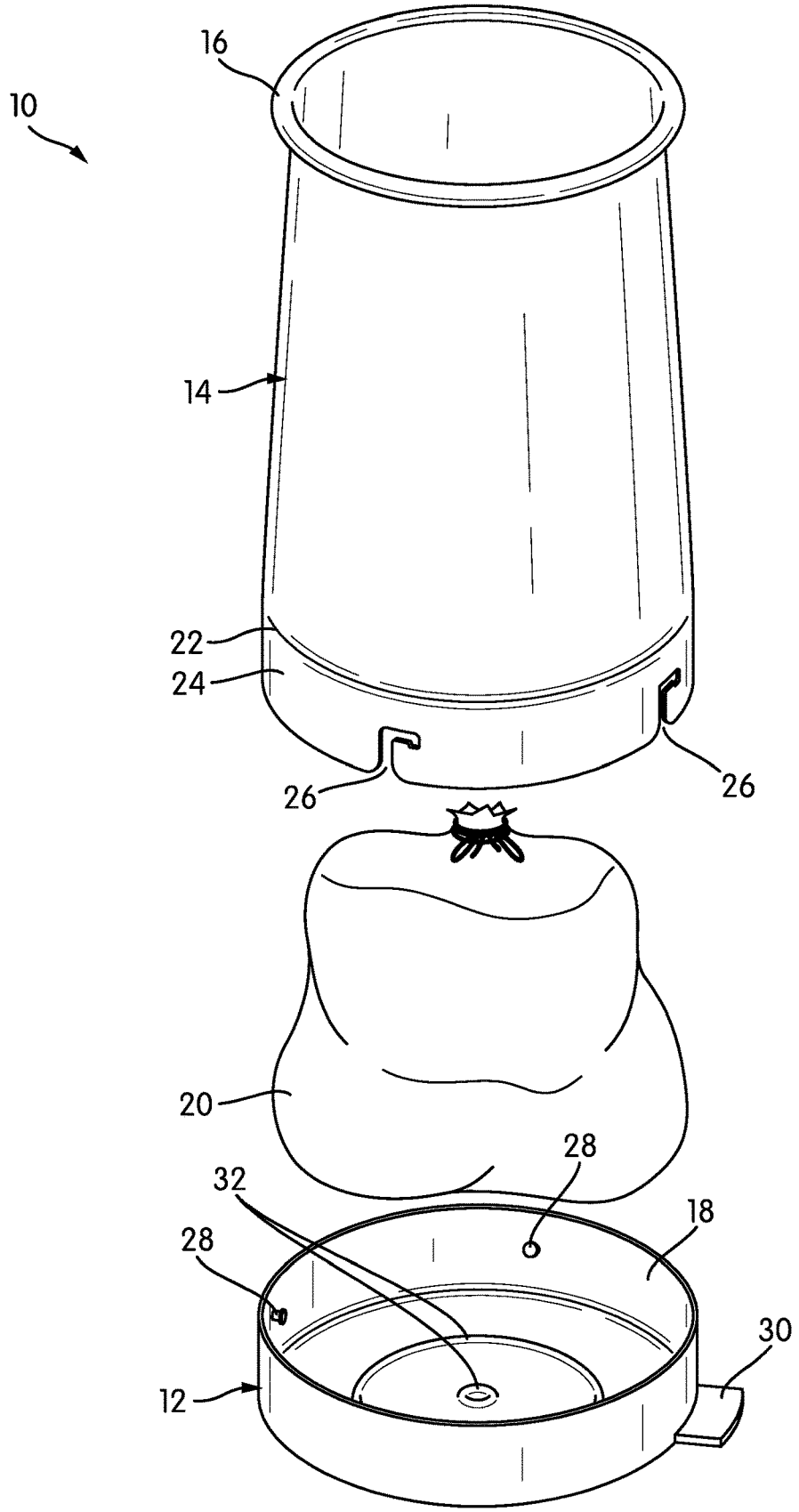
FIG. 2 is an exploded perspective view of the trash can of FIG. 1.

FIG. 2 is an exploded view of the trash can 10, showing the base 12 separated from the sidewall 14. The base 12 is round and includes a raised perimeter wall 18. The raised perimeter wall 18 helps the base 12 to connect with the sidewall 14, as will be described below in more detail, and may also help to contain any spills or leaks from a trash bag 20, which is shown in FIG. 2 for reference.

The full extent of the sidewall 14 can be seen in FIG. 2. As shown, and as was described briefly above, the sidewall 14 increases diameter from its top, adjacent the lip 16, toward its bottom and the base 12. However, in this embodiment, as can be seen in FIG. 2 and in FIG. 3, a cross-sectional view taken through Line 3-3 of FIG. 1, the sidewall 14 does not increase constantly from top to bottom. Rather, there is a plane, indicated at 22 in FIGS. 2 and 3 below which the sidewall 14 straightens to extend vertically. Thus, the plane 22 represents the maximum diameter of the sidewall 14, and the diameter of the sidewall 14 remains constant below it. The straight section 24 of the sidewall 14 facilitates engagement with the base 12.

Figure 3:
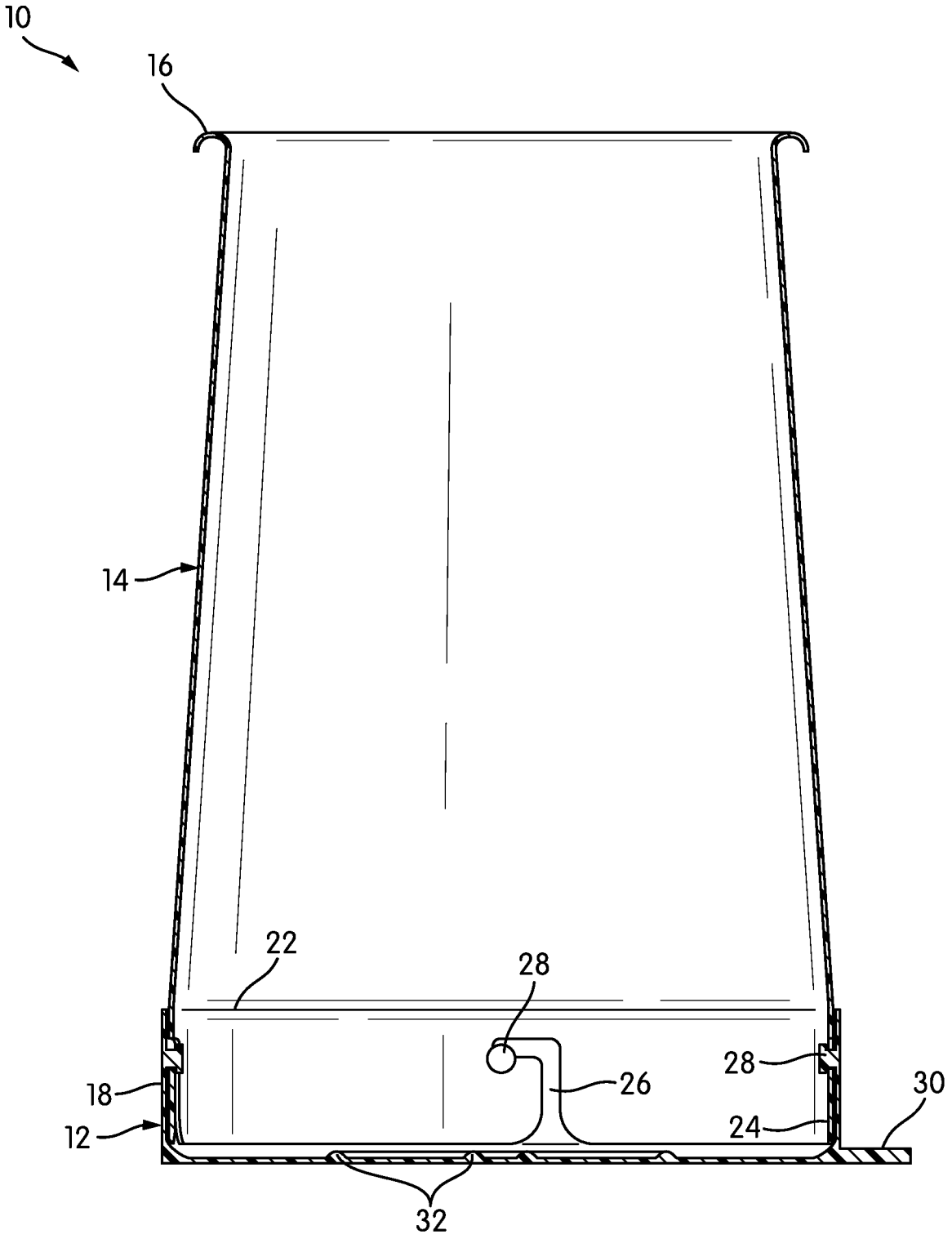
FIG. 3 is a cross-sectional view of the trash can, taken through Line 3-3 of FIG. 1.

The straight section 24 is about as tall as the raised perimeter wall 18 of the base 12, such that when the sidewall 14 is installed on the base 12, the sidewall 14 begins to taper at about the upper extent of the perimeter wall 18. The relative sizes of the straight section 24 and the perimeter wall 18 may vary from embodiment to embodiment with the overall size of the trash can 10, typically, the overlap between the two 18, 24 extends at least a few inches for stability between the base 12 and sidewall 14. As can be seen in FIGS. 2 and 3, there is no constriction in the width of the sidewall 14—the sidewall 14 straightens but does not reduce in diameter as it meets the base 12. The straight-sided nature of the sidewall 14 may make it easier to remove the sidewall 14 with a trash bag 20 installed and avoids the problem of the trash bag 20 snagging or tearing on the sidewall 14 as the sidewall 14 is removed.

FIGS. 2 and 3 also illustrate the way in which the base 12 and the sidewall 14 engage and interlock. Specifically, the bottom of the sidewall 14 includes a number of inverted, L-shaped slots 26 that open at the bottom and extend upwardly and to the side. In the illustrated embodiment, there are four of these slots 26 around the circumference of the bottom of the sidewall 14, spaced evenly at 90° intervals, although more or fewer slots 26 may be used in other embodiments. All of these slots 26 extend in the same direction.

The inner face of the perimeter wall 18 of the base 12 has complementary engaging structure 28 to engage with the slots 26. In this embodiment, the complementary engaging structure 28 comprises a corresponding number of inwardly-extending horizontal posts 28 with enlarged vertical flanges at their inward most extents. These posts 28 engage and ride within the slots 26. When the posts 28 are at the upper terminus of the slots 26, they are secured within the slots 26 and the sidewall 14 is secure on the base 12.

Practically, this means that, as indicated by the arrow in FIG. 1, to remove the sidewall 14 from the base 12, one twists the sidewall 14 a small amount and then lifts the sidewall 14 away from the base 12. In order to keep the base 12 still while this is done, a projection 30 is provided along the outer face of the base 12. The projection 30 is sized so that the user can step on it to keep the base 12 still. The process is reversed for placing the sidewall 14 back on the base 12.

The slots 26 need not be strictly L-shaped in all embodiments. Any slot that extends up into the sidewall 14 and changes direction in a way that would allow the base 12 and sidewall 14 to resist separation forces. For example, a slot that has a sufficient continuous curve may be useful. Ultimately, it is helpful if the slots 26 and their corresponding engaging structures 28 allow for a smooth, natural movement when the sidewall 14 is removed or replaced on the base 12.

One advantage of the trash can 10 is that its mechanism for connecting and disconnecting the sidewall 14 from the base 12 is simple and easily used, and can be done in essentially one movement, without the need to secure or undo straps, latches or other such structures. The straight-sided sidewall 14 also allows the maximum amount of space for a trash bag 20.

The basic shape illustrated in FIGS. 1-3 may be modified. For example, as shown particularly in FIG. 2, stiffening ribs 32 and other such structures may be added to the base 12 and the sidewall 14 to increase stiffness. The need for such structures will depend on the size of the trash can 10, the wall thicknesses of the base 12 and sidewall 14, and other such considerations.

The trash can 10 and its components 12, 14 may be made of a plastic, a rubber, or another such material. High-density polyethylene (HDPE) is one suitable material. The base 12 and sidewall 14 may be injection molded, cast, machined from a block of material, additively manufactured, or made in whichever way is appropriate considering the material.

While the invention has been described with respect to certain embodiments, the description is intended to be exemplary, rather than limiting. Modifications and changes may be made within the scope of the invention, which is defined by the appended claims.

What is claimed is:

1. A trash can, comprising:

a enclosed sidewall having an upper end and a lower end spaced from the upper end, both the upper end and the lower end being open, and a set of slots, open at the lower end and extending upward from the lower end into the sidewall with a directional change; and a base, separable from the sidewall and adapted to accommodate the sidewall so as to close the lower end of the sidewall, the base having a raised perimeter wall with a set of projections, engageable with the set of slots, along an inner face of the perimeter wall;

wherein the sidewall increases in diameter from the upper end to a bottom portion with a constant diameter that terminates at the lower end, the bottom portion having a height that is about equal to a height of the raised perimeter wall of the base, the arrangement being such that the bottom portion of the sidewall is parallel to the raised perimeter wall of the base when the base and the sidewall are engaged with one another.

2. The trash can of claim 1, wherein the sidewall has round cross-sections.

3. The trash can of claim 1, wherein each of the set of slots has an inverted L-shape.

4. The trash can of claim 1, wherein the set of slots are spaced evenly around a circumference of the sidewall.

5. The trash can of claim 1, further comprising a projection on an outer wall of the base.

* * * * *